US009307812B2

(12) United States Patent
Knox, Jr.

(10) Patent No.: US 9,307,812 B2
(45) Date of Patent: Apr. 12, 2016

(54) MAZE-TYPE COIN BANK

(75) Inventor: William Knox, Jr., Painesville, OH (US)

(73) Assignee: Mag-Nif Incorporated, Mentor, OH (US)

( * ) Notice: Subject to any disclaimer, the term of this patent is extended or adjusted under 35 U.S.C. 154(b) by 594 days.

(21) Appl. No.: 13/533,284

(22) Filed: Jun. 26, 2012

(65) Prior Publication Data

US 2013/0225031 A1 Aug. 29, 2013

Related U.S. Application Data

(60) Provisional application No. 61/604,302, filed on Feb. 28, 2012.

(51) Int. Cl.
*A45C 1/12* (2006.01)
*A63H 33/00* (2006.01)
*A63F 9/00* (2006.01)

(52) U.S. Cl.
CPC ..... *A45C 1/12* (2013.01); *A63F 9/0078* (2013.01); *A63H 33/00* (2013.01)

(58) Field of Classification Search
CPC ..... A45C 1/12; A63H 33/00; G07F 17/105; G07F 9/06; A63F 9/12; A63F 9/0078; A63F 7/022; A63F 7/02
See application file for complete search history.

(56) References Cited

U.S. PATENT DOCUMENTS 433,736 A * 8/1890 Lockwood ..... A45C 1/12 193/12
613,450 A 11/1898 Kolesar
615,381 A * 12/1898 Brockett ..... A45C 1/12 232/6
812,327 A * 2/1906 Cranner ..... G07D 3/04 193/12
1,124,896 A 1/1915 Hartman
1,476,735 A * 12/1923 Gerhard ..... A45C 1/12 232/4 R
2,509,340 A * 5/1950 Fly ..... A63F 7/042 273/109
2,622,365 A * 12/1952 Grow ..... G07F 17/105 194/261
3,218,754 A * 11/1965 Bruce ..... A63F 7/041 206/0.83
3,228,506 A * 1/1966 Stackhouse ..... G07F 17/14 194/290
3,338,250 A * 8/1967 Mehelich ..... G07D 3/08 232/5
3,840,173 A 10/1974 Rolff
4,068,797 A 1/1978 Rudolf et al.
4,121,826 A 10/1978 Liberatore
4,297,807 A 11/1981 Buettner
4,401,259 A 8/1983 Knutson
D289,218 S 4/1987 Divnick
4,762,512 A 8/1988 Divnick (Continued)

OTHER PUBLICATIONS

British Combined Search and Examination Report of GB1303479.8 dated Jul. 8, 2013, 5 pages.

(Continued)

*Primary Examiner* — Gene Kim
*Assistant Examiner* — Alyssa Hylinski
(74) *Attorney, Agent, or Firm* — Fay Sharpe LLP

(57) ABSTRACT

A maze-type coin bank includes a housing having a wall, an inlet opening and an exit door. A lock is mounted to one of the wall and the exit door for selectively opening the exit door. A three-dimensional track construction is held in the housing and includes a plurality of sections extending along different axes which accommodate an associated coin for movement along the track construction. The track construction includes a coin entrance portion communicating with the inlet opening and a maze solution portion. Solving the maze involves placing a coin in the maze solution portion of the track construction in order to facilitate the opening of the exit door.

17 Claims, 14 Drawing Sheets

(56) References Cited

U.S. PATENT DOCUMENTS

| | | | | | |
|---|---|---|---|---|---|
| 4,787,873 | A | * | 11/1988 | Borrmann | A45C 1/12 193/29 |
| 4,805,910 | A | * | 2/1989 | Monticolombi | A63F 9/0078 273/153 R |
| 4,871,055 | A | | 10/1989 | Poythress et al. | |
| D307,503 | S | | 4/1990 | Divnick | |
| D320,299 | S | | 9/1991 | Beiter et al. | |
| 5,090,699 | A | * | 2/1992 | Friedman | A63F 7/02 273/118 R |
| D324,751 | S | | 3/1992 | Perkitny | |
| 5,122,093 | A | * | 6/1992 | Perkitny | G07D 3/04 446/9 |
| D329,933 | S | | 9/1992 | Perkitny | |
| 5,176,238 | A | * | 1/1993 | Deglau | G07F 17/32 194/338 |
| 5,310,184 | A | * | 5/1994 | Grist | A63F 7/041 273/153 R |
| 5,437,408 | A | * | 8/1995 | Chesnut | A45C 1/12 194/344 |
| 6,551,183 | B2 | | 4/2003 | Knox, Jr. et al. | |
| 6,554,692 | B2 | * | 4/2003 | Knox, Jr. | G07D 3/04 446/8 |
| D477,452 | S | | 7/2003 | Chia | |
| D491,335 | S | | 6/2004 | Nwadike | |
| 6,793,570 | B1 | | 9/2004 | Wekstein | |
| D514,770 | S | | 2/2006 | Henderson et al. | |
| 7,704,118 | B2 | | 4/2010 | Divnick | |
| D662,993 | S | * | 7/2012 | McGinnis | D21/300 |

OTHER PUBLICATIONS http://perplexus.net/, Screenshot of "Everything Perplexus", Jun. 26, 2012.

http://farm4.static.flickr.com/3088/3153545371_609928ea0d_z.jpg?zz=1, Web page, Entitled "Magical Intenect Ball", Feb. 13, 2012.

* cited by examiner

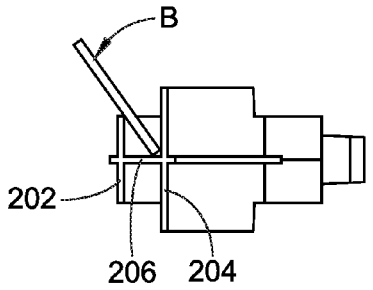
FIG. 11A
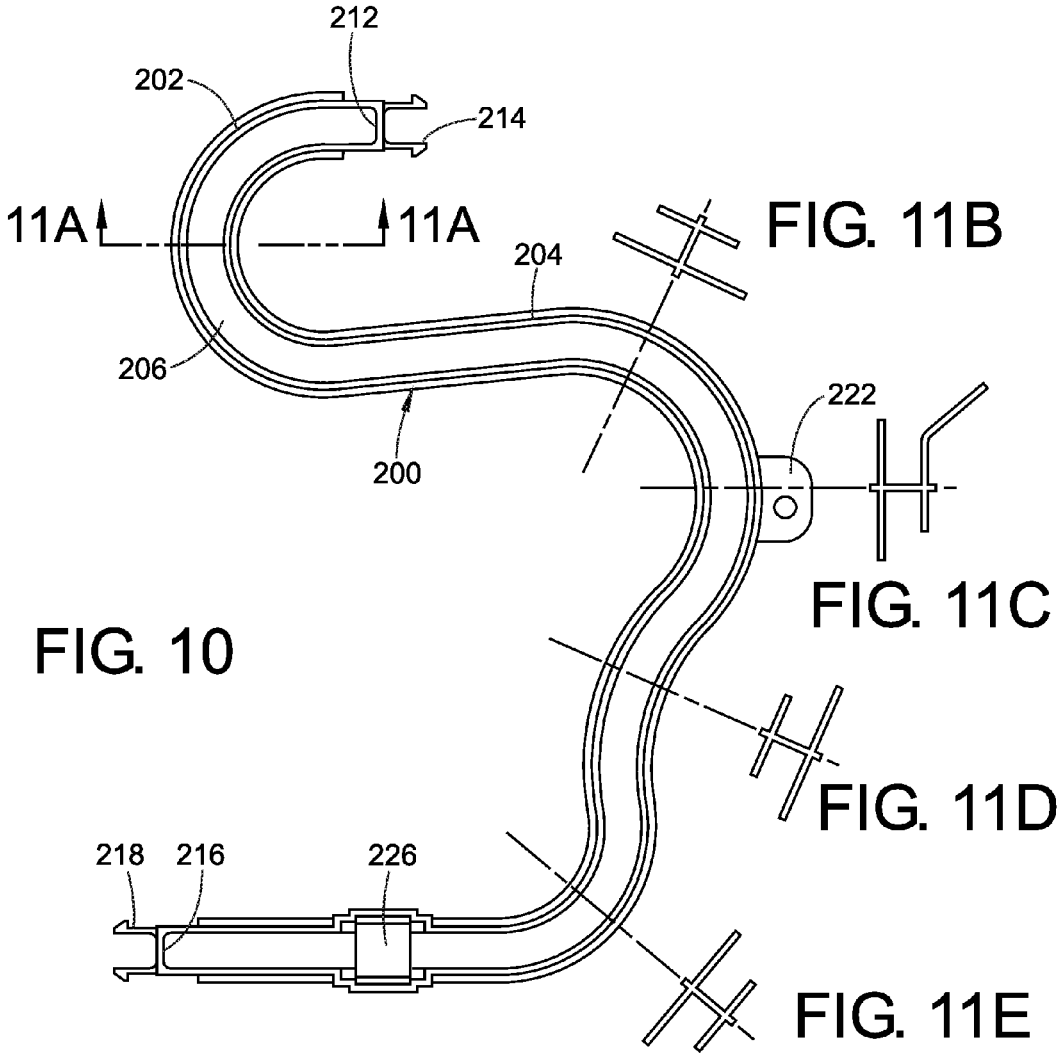
FIG. 11B
FIG. 11C
FIG. 10
FIG. 11D
FIG. 11E

MAZE-TYPE COIN BANK

This application claims priority from the U.S. Provisional Application Ser. No. 61/604,302 filed on Feb. 28, 2012, the subject matter of which is incorporated hereinto in its entirety.

The present disclosure relates to banks, and more particularly to coin banks which have a multiplicity of maze-type coin paths connecting a coin inlet to a maze solution portion if successful and to a coin storage reservoir if unsuccessful. The disclosure also relates to a puzzle where players maneuver the coin on various paths, providing a three dimensional experience.

BACKGROUND

There have been a variety of banks designed to provide an extended viewable path along which coins travel before reaching a storage reservoir. Also known are puzzles in which players maneuver a marble or the like object in three dimensional space to guide the marble along a chosen path before the marble reaches its destination. However, it would be advantageous to provide a three-dimensional maze-type coin bank in which multiple viewable coin paths extend in three-dimensional space and connect a coin inlet to at least one of a coin storage reservoir and a coin receiving member. It would also be desirable to allow opening of the coin storage reservoir only if the player successfully maneuvers the coin to the coin receiving member in order to solve the puzzle.

BRIEF DESCRIPTION OF THE DISCLOSURE

In accordance with one embodiment of the present disclosure, there is provided a maze-type coin bank comprising a housing including a wall, an inlet opening and an exit door. A lock is mounted to one of the wall and the exit door for selectively opening the exit door. A three-dimensional track construction is held in the housing. It includes a plurality of sections extending along different axes, which accommodate an associated coin for movement along the track construction. The track construction includes a coin entrance portion communicating with the inlet opening and a maze solution portion. Solving the maze involves placing a coin in the maze solution portion of the track construction in order to facilitate an opening of the exit door.

In accordance with another aspect of the present disclosure, a maze-type coin bank comprises a housing, including a coin entrance opening and a door mounted to the housing. A coin storage area is defined in the door or between the housing and the door. A lock is mounted to one of the door and the housing. A coin track is accommodated in the housing. The coin track includes a plurality of sections extending along different axes, a coin entrance portion and a maze solving portion. An associated coin is movable along the coin track from the coin entrance portion to the maze solving portion in order to facilitate an actuation of the lock.

A method is provided for minimizing a curvature of a coin track on which coins can travel. The method comprises providing a coin track including a base wall and a pair of opposed side walls and determining a diameter of the largest diameter coin meant to be handled on the coin track. A desired curvature of the coin track is then determined. A width of the base wall of the track or a height of one of the opposed side walls of the track is adjusted in order to accommodate the largest diameter coin meant to be handled on the coin track having the desired curvature.

BRIEF DESCRIPTION OF THE DRAWINGS

The disclosure may take physical form in certain parts and arrangements of parts, an embodiment of which will be described in detail in this specification and illustrated in the accompanying drawings which form a part hereof and wherein:

FIG. 10 is a top plan view of the track section of FIG. 9;

FIGS. 11*a*-11*e* are cross-sectional views of selected portions of the track section of FIG. 10;

DETAILED DESCRIPTION

Figure 1:
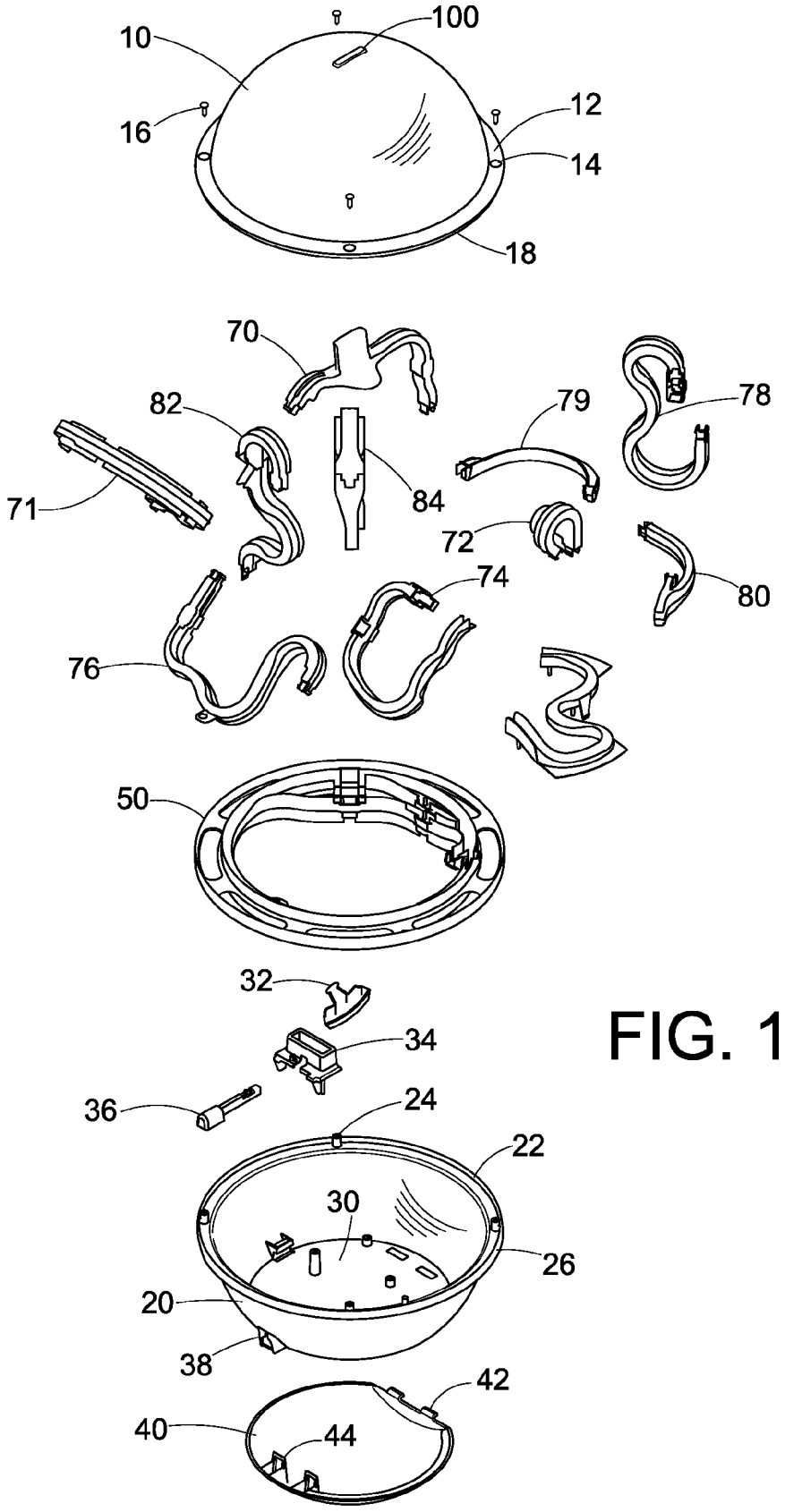
FIG. 1 is an exploded perspective view of a coin bank puzzle, according to an embodiment of the present disclosure.
Figure 5:
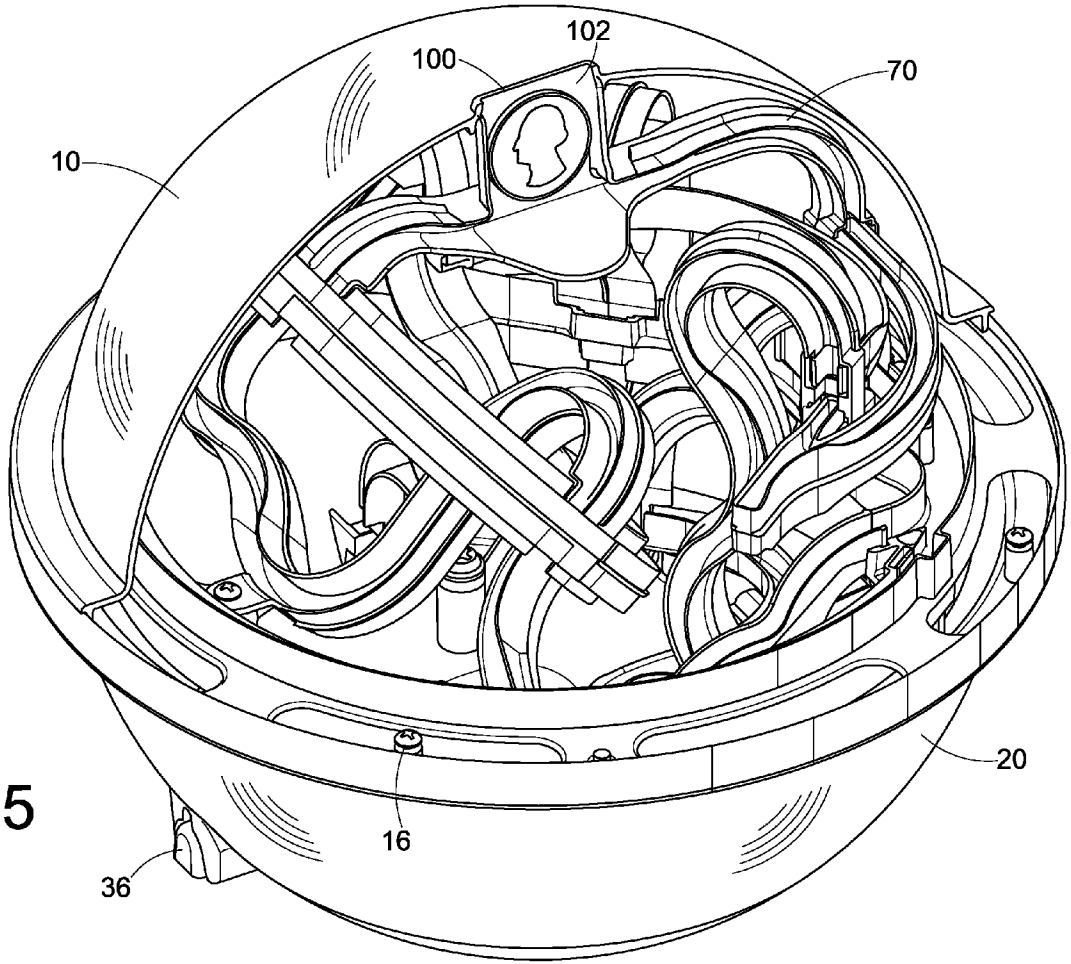
FIG. 5 is an assembled perspective view, partially broken away, of the coin bank puzzle of FIG. 1.

Referring now to the drawings wherein the showings are for purposes of illustrating a preferred embodiment of the disclosure only and not for purposes of limiting same, FIG. 1 shows one embodiment of a maze-type coin bank according to the instant disclosure. The disclosed coin bank A (FIG. 5) includes an outer shell or housing which, in this embodiment, comprises a hemispherical top half 10. The top half includes an outwardly extending flange 12 located at the maximum diameter of the top half, defined at its open end. Several apertures 14 are provided in the flange 12. Suitable fasteners 16 can extend through the apertures 14. Depending from the flange 12 is an annular shoulder 18. Cooperating with the top half 10 is a shell or housing bottom half 20 which can comprise another hemispherical housing member. The bottom half includes a flange 22 located at its upper open end. Bosses 24 are located on the flange. These cooperate with the openings 14 and fasteners 16 of the top half so that the fasteners are accommodated in suitable apertures defined in the bosses. The fasteners can be threaded, and can for example, include self-tapping screws. In this way, the top and bottom halves can be selectively assembled and secured to each other. A skirt 26 extends from adjacent an outer periphery of the flange 22. In one embodiment, the skirt 26 encircles the shoulder 18 provided on the top half flange 12.

A door 40 is pivotally connected to the bottom half 20 of the housing. In this embodiment, the door includes at least one pivot member, which can be termed a hinge section 42 and at least one catch member 44.

Contained within the pair of hemispherical housing members 10 and 20 is a track construction. The track construction comprises a maze-type arrangement or labyrinth with multiple paths on which the coin can travel. One or more of these paths can lead to an exit or correct destination. Other paths can lead to dead ends, wrong turns, pitfalls or incorrect destinations. A three-dimensional track construction is provided so that a coin travelling down the track construction needs to be maneuvered along the multiple tracks by suitably manipulating, rotating or reorienting the housing. To solve the puzzle, the coin needs to remain on the selected coin path as the coin moves or travels from an inlet location to a puzzle solving location.

In one embodiment, the coin can roll on the track construction, such as in the design illustrated herein. In another embodiment, not shown, the coin could slide on a face down the track construction by suitably maneuvering the housing. Solving the puzzle requires a high level of dexterity to manipulate the coin through the track construction. The user has multiple choices of paths on which to move the coin in an attempt to solve the puzzle. Put another way, there are several paths or routes for the coin to travel in an attempt to reach the puzzle solving location. Manual dexterity is a requirement for solving the puzzle and for maneuvering the coin from the inlet location to the puzzle solving location.

If the puzzle is not solved, the coin will end up in a coin storage location. As will be discussed below, the coin storage location holds a reservoir of coins in the coin bank. The coin solving location will allow the reservoir to be accessed by the player of the puzzle, but only upon solving the puzzle or maze. The track construction includes a main track 50, as well as a number of track sections, including an initial or first track section 70, another track section 72 and still other track sections 74-86. At least one movable coin transfer element 32 communicating with one or more track sections can also be provided. The track sections can be of differing shapes, sizes, lengths and configurations. It should be appreciated that the track sections can be connected to each other at a variety of locations along the length of a track section, as may be desired in order to design a particular track configuration for the maze.

Figure 12:
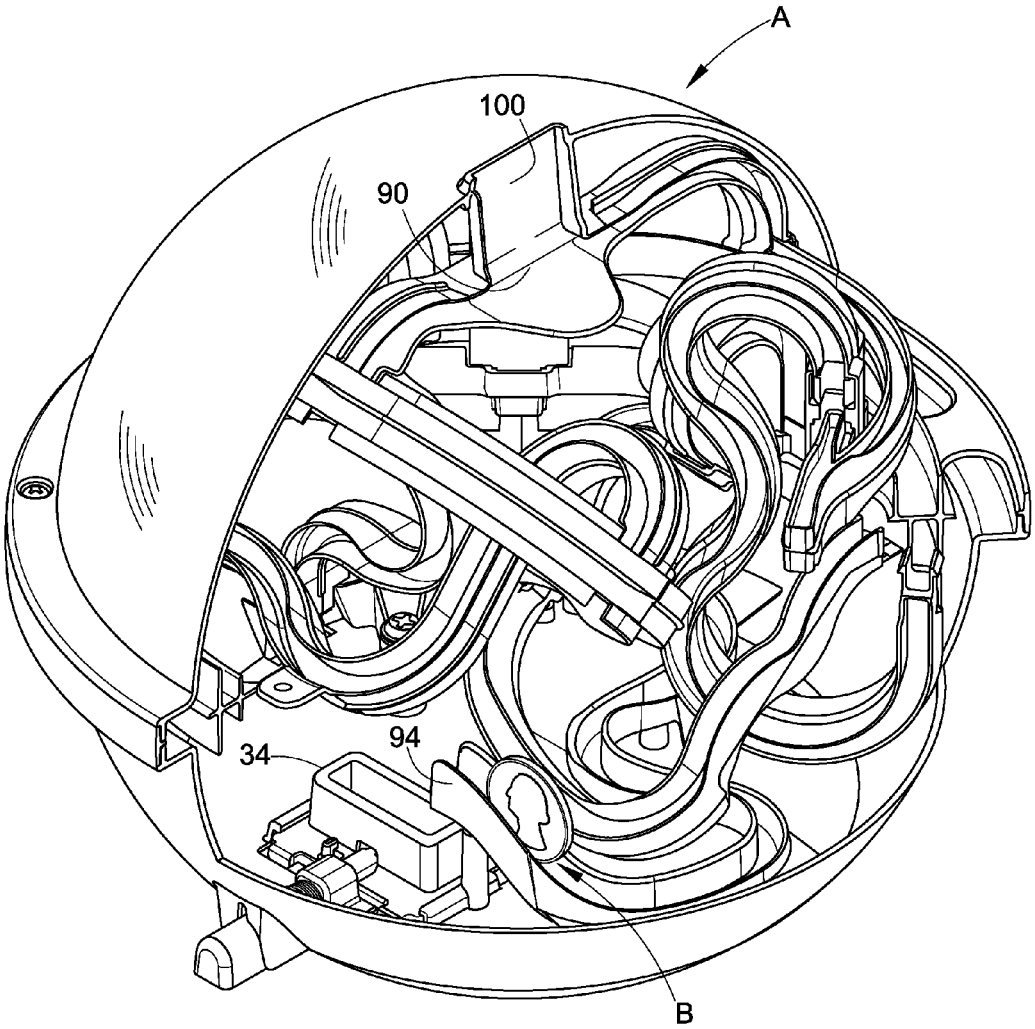
FIG. 12 is a perspective view of the maze of FIG. 5, partially broken away for clarity, illustrating a coin adjacent a puzzle solving location of the maze.

With reference now to FIG. 12, the track construction also includes a coin entrance portion 92 that communicates with an inlet opening of the housing A, as well as a maze solution portion 94. The maze solution portion communicates with a coin receptacle.

It should be appreciated that the track can have sections which are oriented generally perpendicular to each other. Alternatively, one or more track sections can be connected to each other at any given acute or obtuse angle as may be desirable for a particular maze configuration.

One or more of the track sections can be double sided. Such a construction adds visual interest to the maze and may perhaps lead a participant attempting to solve the maze down an incorrect path. Moreover, the frequent manipulations of the housing may ultimately lead to a coin being located on an opposite side of a track portion that has already been used. As mentioned, the track construction can further include a coin transfer element or moving member 32 which can communicate with track section 82. In the disclosed embodiment, the coin transfer member pivots from one side of track section 82 to the other so that the coin can then travel via another track section such as 76 or 79 and eventually reach a coin receptacle, receiving member, or coin catcher 34. The coin catcher 34 communicates with the track construction via the maze solution portion 94 of the track. The track construction allows a coin to move from a horizontal path to a vertical path and vice versa as several track sections have end portions that are oriented generally perpendicular to each other. The track construction runs in three-dimensions, obligating the player to maneuver the coin traveling down the track in an attempt to reach the maze solution portion. As mentioned, solving of the puzzle will require manual dexterity by the user.

Figure 2:
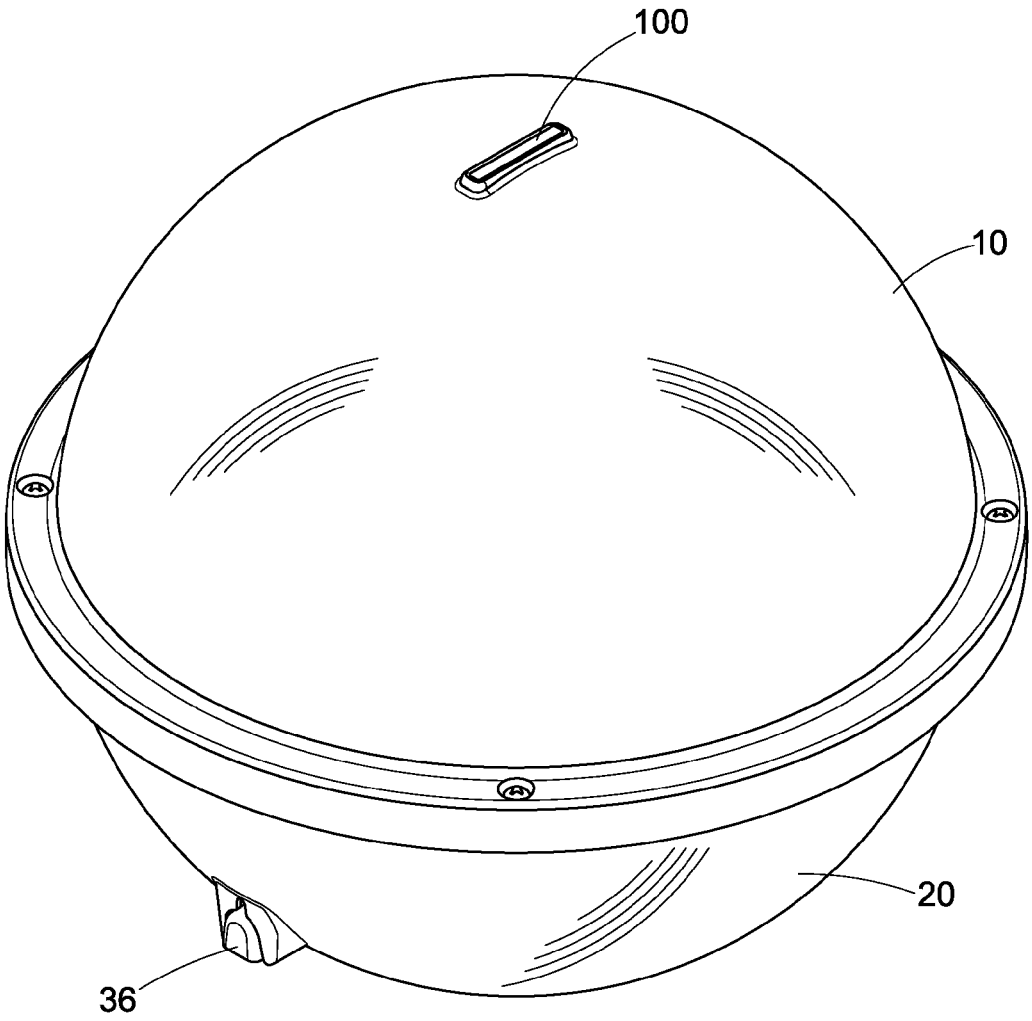
FIG. 2 is an assembled view of an outer spherical housing portion of the coin bank puzzle of FIG. 1.
Figure 3:
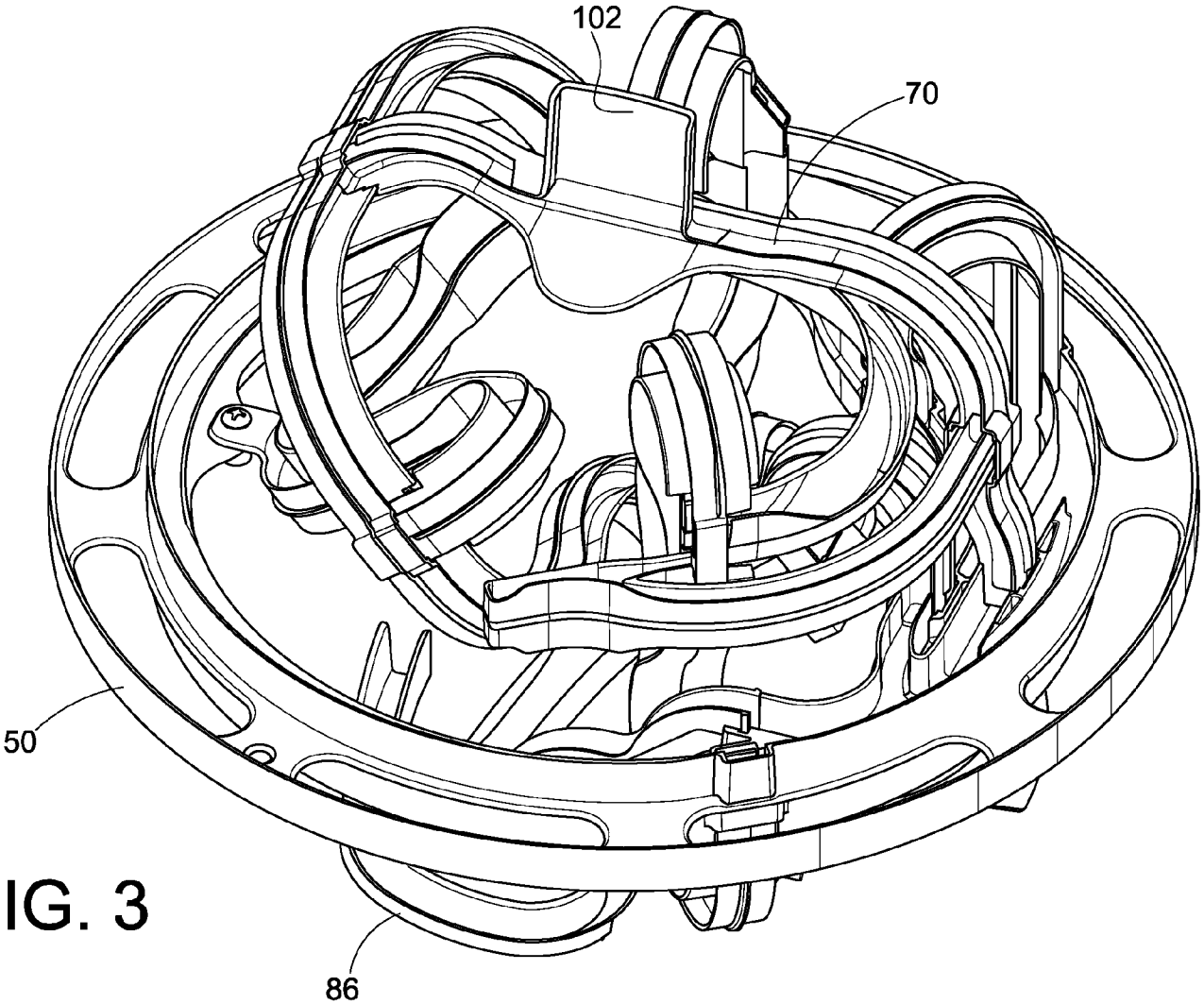
FIG. 3 is an assembled perspective view of a track portion of the coin bank puzzle of FIG. 1, the track portion being held within the outer spherical housing portion shown in FIG. 2.
Figure 4:
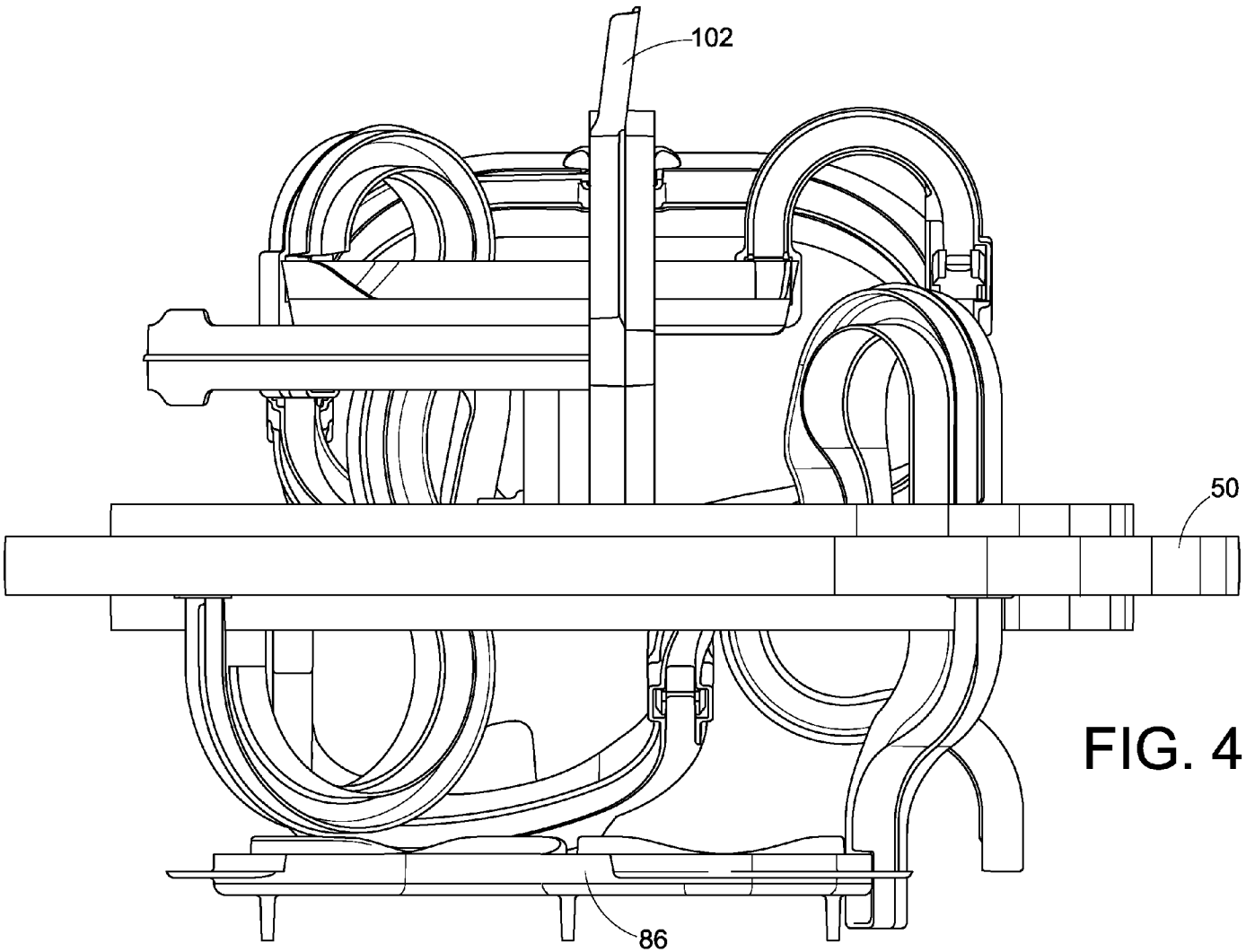
FIG. 4 is side elevational view of the track portion of FIG. 3.

With reference now to FIG. 2, provided on the hemispherical top half 10 of the housing is a coin slot 100 allowing coins to enter the track construction. With reference now to FIG. 3, the coin slot cooperates with a guide 102 which is defined in the first track section 70. Once the coin has entered track section 70, it is then guided by the player so that the coin travels along the remaining track sections 72-86, the transfer element 32, as well as the main track section 50. If the player has been successful in solving the maze, the coin eventually reaches the coin catcher 34. Otherwise, if the coin leaves the track construction, the coin will fall onto the bottom wall 30.

Figure 6:
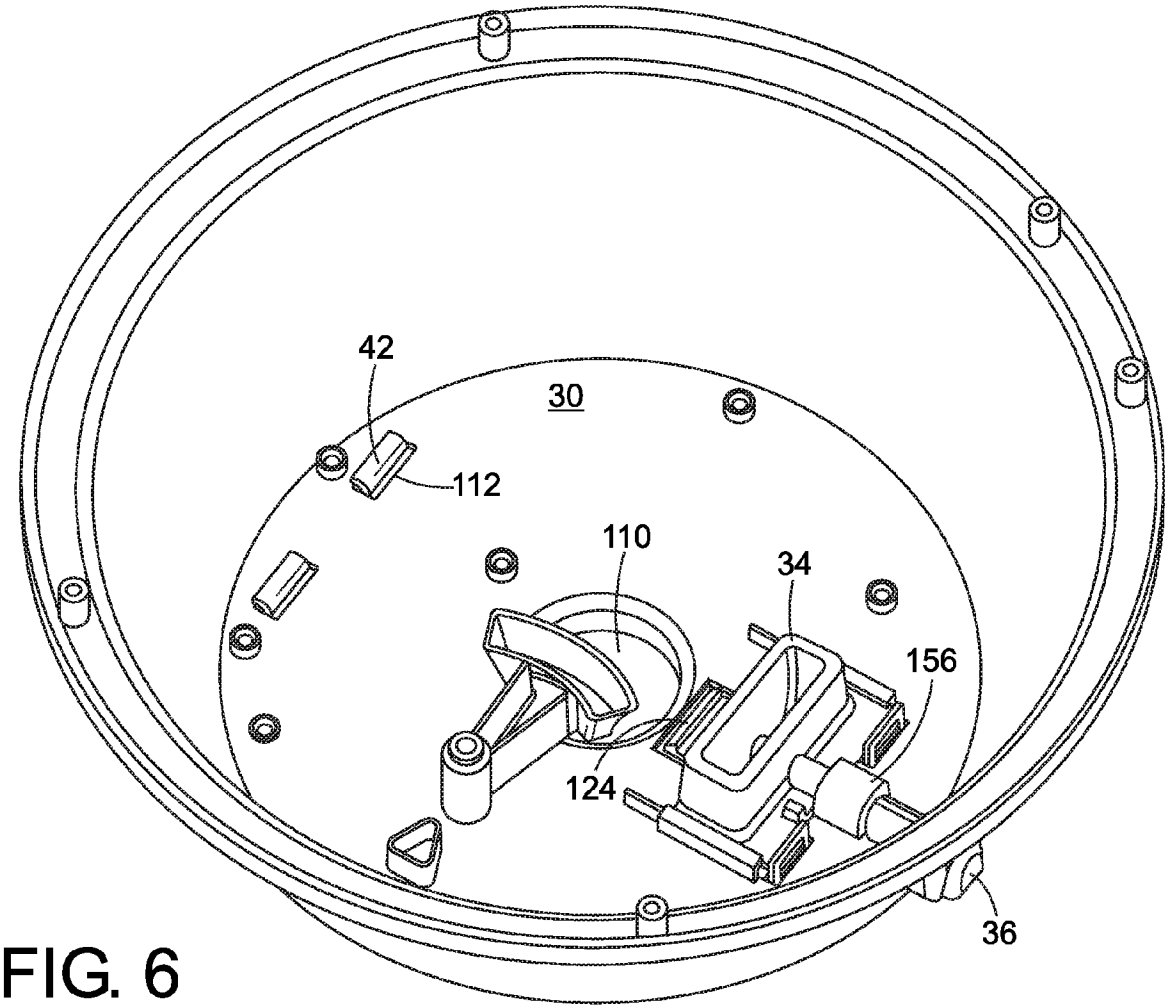
FIG. 6 is an enlarged perspective view of a bottom half of the coin bank puzzle housing of FIG. 1.

With reference now also to FIG. 6, the bottom half 20 of the housing, which in this embodiment is generally hemispherical in shape, includes a central opening 110 defined in the wall 30 through which coins can drop into a coin reservoir area that is defined between the wall 30 and the door 40. In the illustrated embodiment, the door 40 is bowl-shaped so as to hold the coins. Also provided is at least one aperture 112 spaced from the opening 110. Selectively housed in the aperture 112 is a pivot member or element 42 of the door 40. The pivot member 42 allows the door to selectively pivot in relation to the remainder of the housing of the coin bank puzzle. Also provided is a latch mechanism 120. The latch mechanism includes a latch member 124 that cooperates with the catch member 44 so as to selectively lock the door 40 in place.

Held on a bottom wall 30 of the bottom half is the transfer element or coin spinner 32 and the coin receiving member or coin catcher 34. Movably mounted to the bottom wall 30 is a push rod 36 which can be manually actuated. The push rod 36 can activate the lock mechanism when a coin correctly lands in the receiving member 34. When that happens, the player can move the push rod 36 so as to actuate the latch mechanism 120. When the rod is pushed, the latch 124 can be opened thereby allowing the door 40 to pivot away from the remainder of the housing bottom half 20. This movement allows the coins, held in the coin storage compartment defined in the door, to be retrieved by the player. On the other hand, if the player is unsuccessful in landing the coin in the receiving member 34, the coin will, instead, fall onto the bottom wall 30 and eventually slide through the opening 110 in the wall 30 and thence into the coin storage container defined by or in the door.

Figure 7:
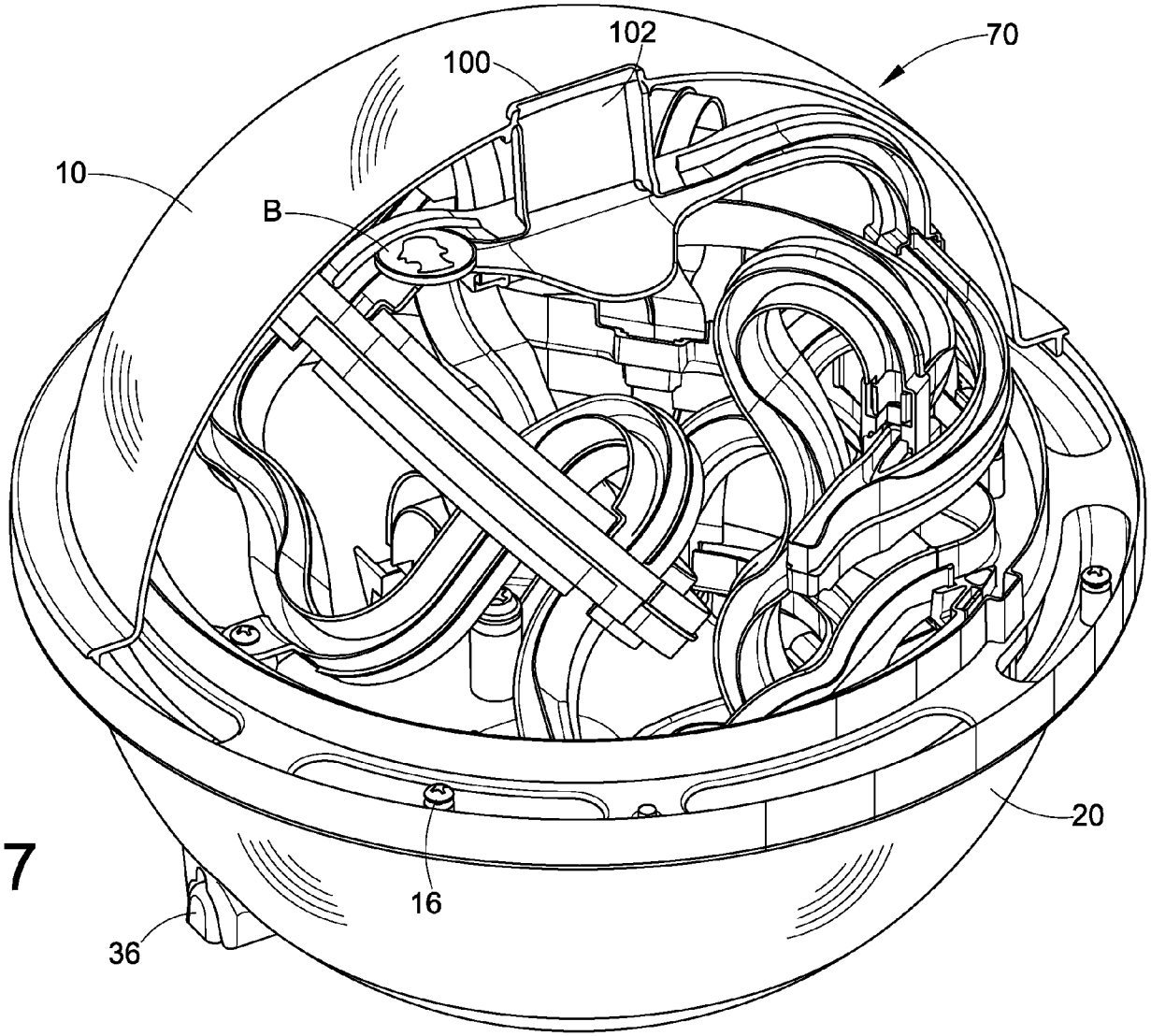
FIG. 7 is a perspective view, partially broken away, for clarity illustrating a coin which has just entered the maze of FIG. 5.

With reference now to FIG. 7, illustrated is a coin B that has recently entered the coin bank A via the coin slot 100 and guide 102. It is apparent that the coin B is immediately turned on its side, thus necessitating that the person playing the maze rotate the housing 90° in order to ensure that the coin does not fall off the track. It is also apparent that should the coin continue towards the left, it will enter another section of the track obligating the player to again rotate the housing in order to keep the coin on the track.

With reference now to FIG. 12, the coin B is there shown as approaching the coin receiving member 34. In other words, the person playing the maze is close to solving the puzzle by depositing the coin B in the coin receiving member 34. Due to the convoluted nature of the track between the entrance point of the maze, i.e., the coin slot 100, and the location of the coin receiving member 34, the person playing the maze needs to reorient the housing of the coin bank a number of times in order to keep the coin B on the track.

Figure 13:
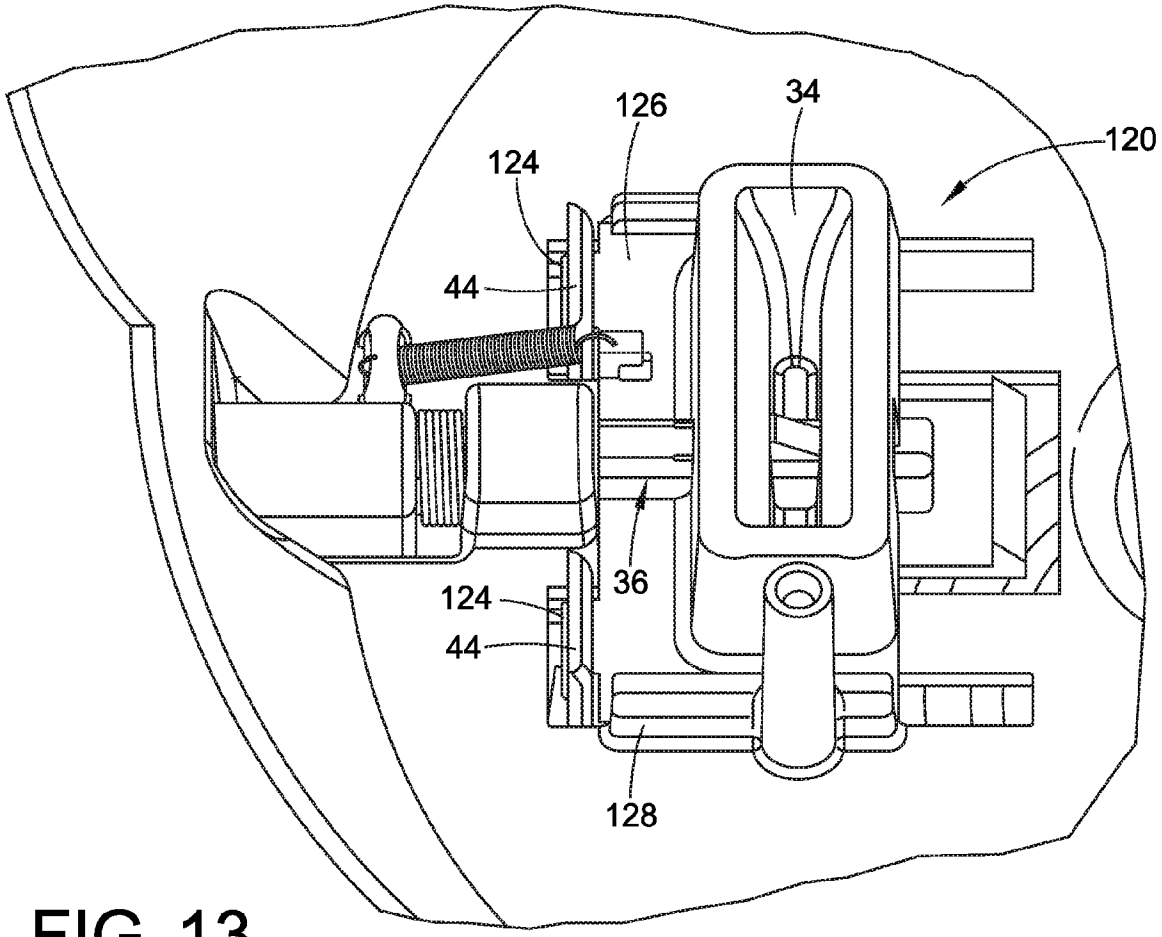
FIG. 13 is an enlarged perspective view of a lock mechanism of the puzzle of FIG. 1 in a first position.
Figure 14:
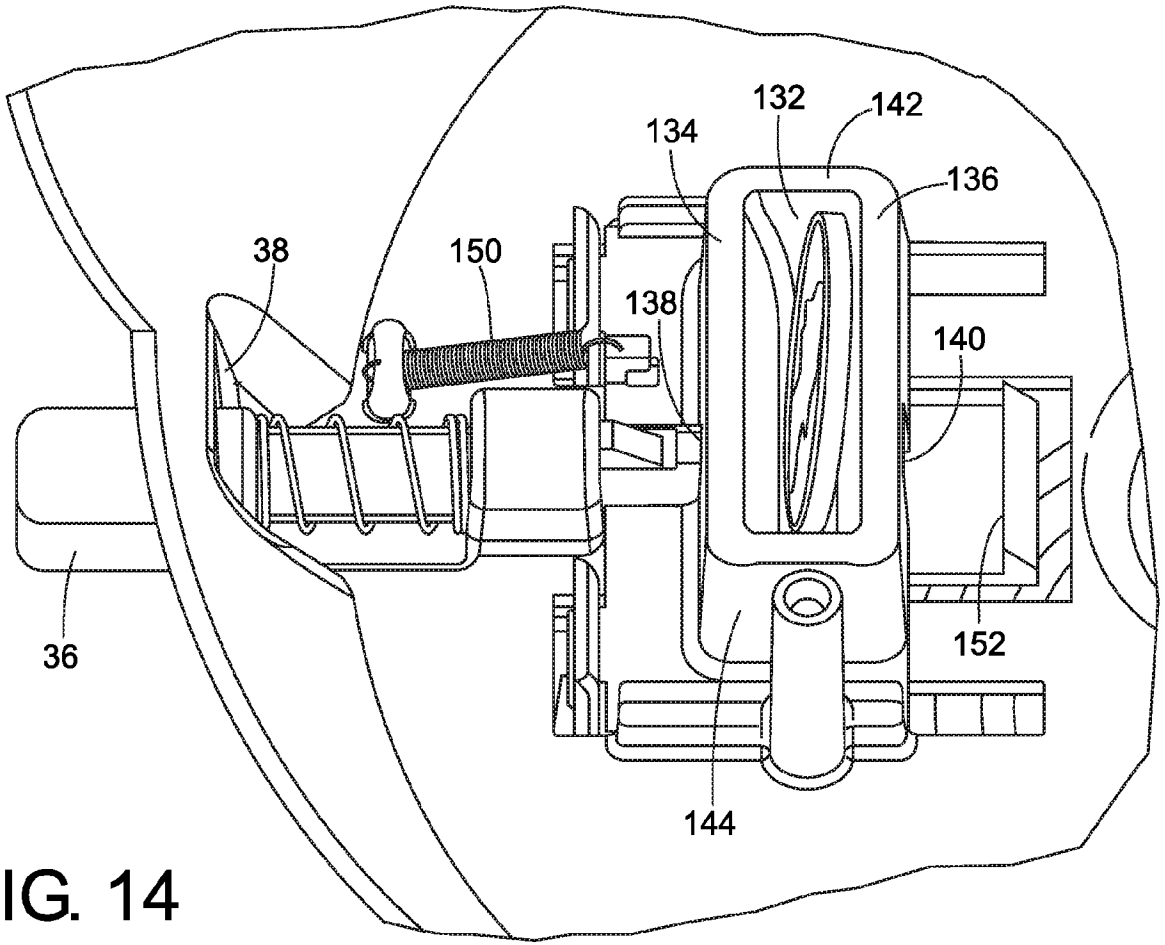
FIG. 14 is a perspective view of the lock mechanism of FIG. 13 in a second position.

With reference now to FIG. 13, the latch mechanism 120 is there illustrated in detail. The latch mechanism includes a pair of latch members 124 which protrude from one side of a base 126. The pair of latch members 124 cooperate with a pair of catch members 44. In this embodiment, the catch members are located on the door 40 as is illustrated in FIG. 1. The base is guided for sliding movement via guides 128. As shown in FIG. 14, located in the coin receiving member or coin catcher 34 is a coin receiving slot 132 which is defined between the first and second end walls 134 and 136. Disposed in the two end walls are first and second openings 138 and 140. These can be aligned. Two side walls 142 and 144 connect the two end walls, thus forming a generally rectangular coin receiving member 34. It is apparent from FIG. 13 that a distal end of the push rod 36 can selectively extend through the aligned openings 138 and 140. When this occurs, the latch mechanism is not moved. Put another way, a person cannot open the door 40 if there is not a coin held in the receiving member 34 because a distal end of the push rod 36 will simply move through the aligned openings 138 and 140. One may push the push rod 36, as shown in FIG. 13, but it will have no effect on the latch mechanism 120, as long as there is no coin located in the receiving member 34.

Figure 15:
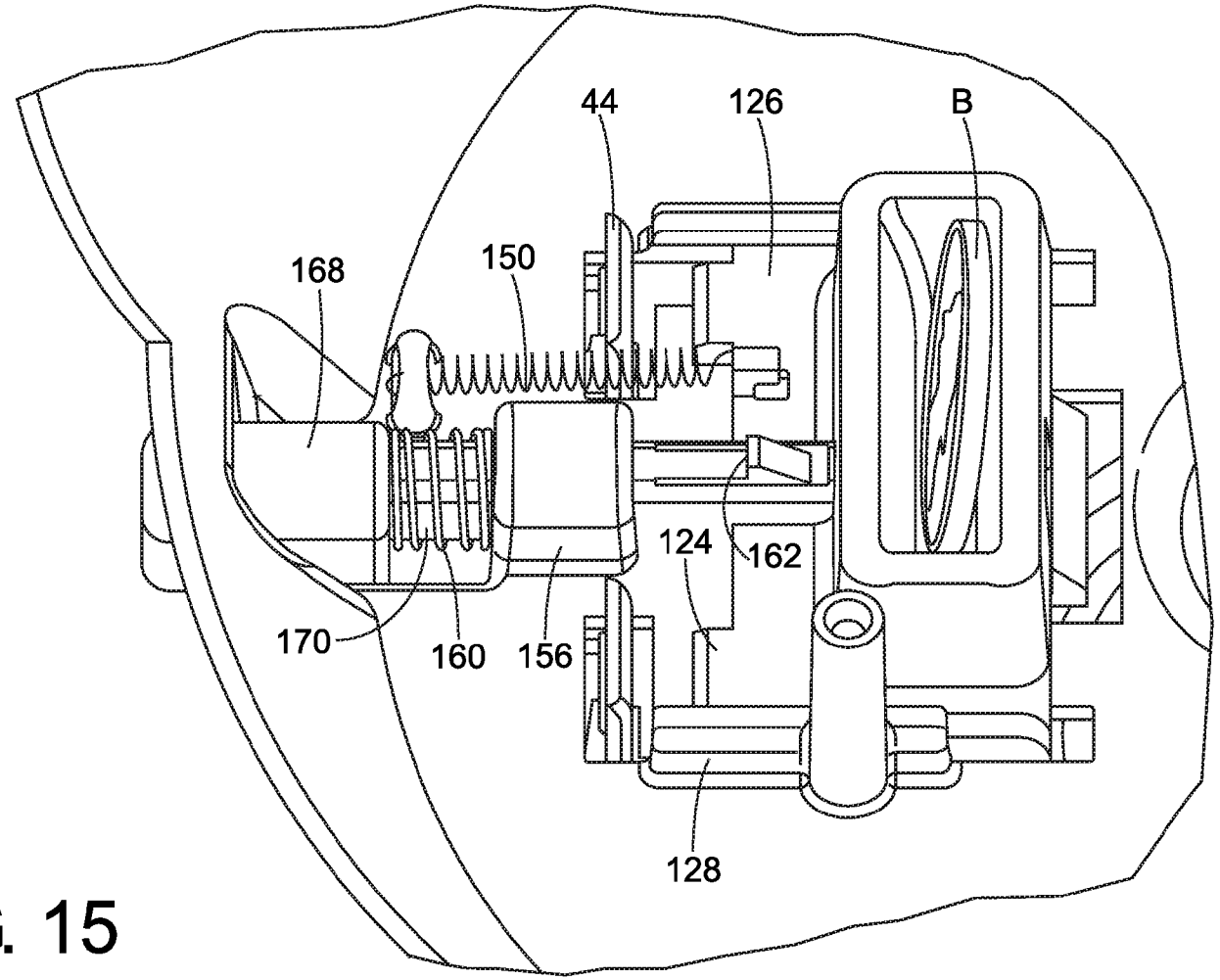
FIG. 15 is a perspective view of the lock mechanism of FIG. 13 in a third position.
Figure 16:
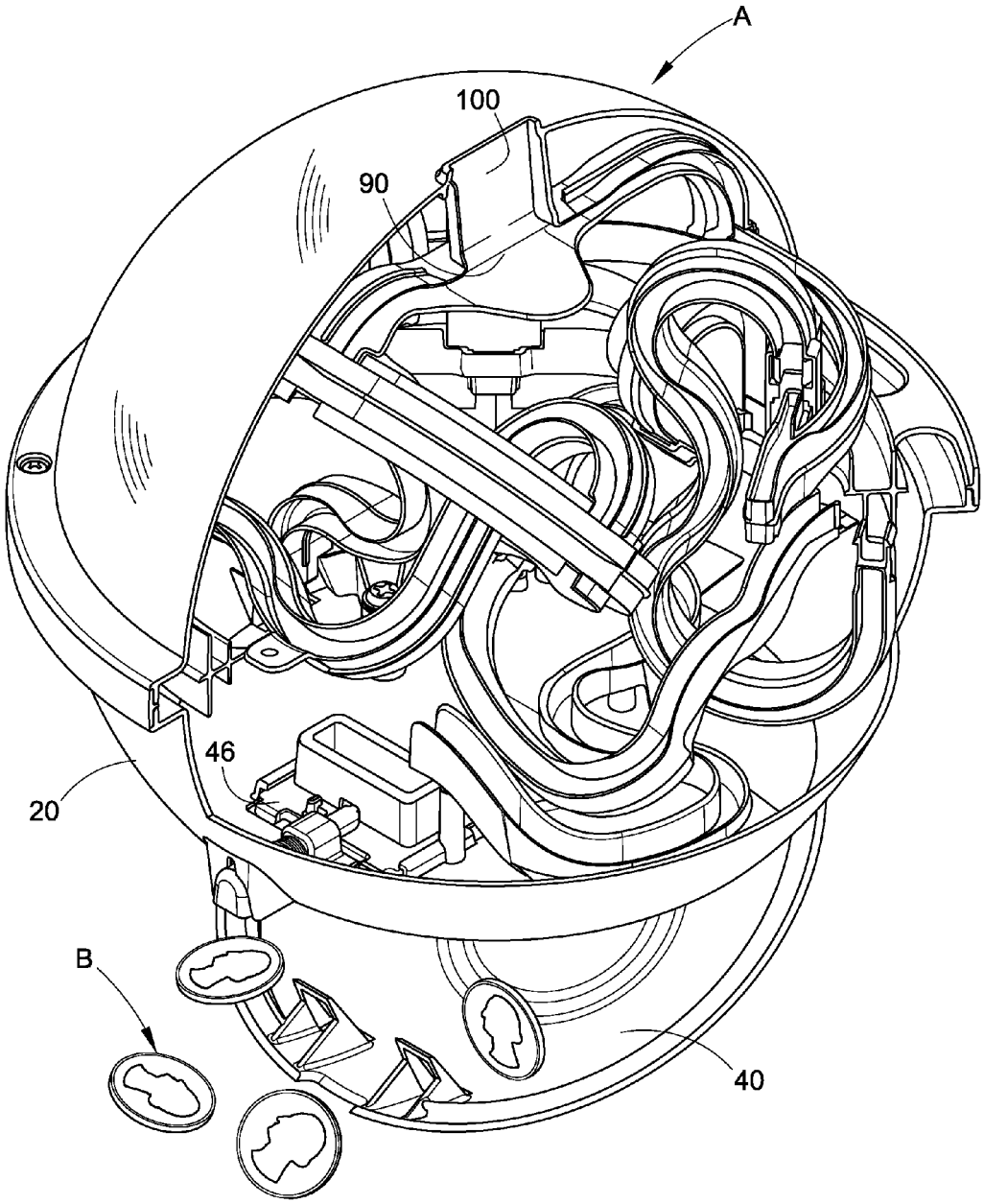
FIG. 16 is a perspective view of the maze of FIG. 12 after the door has been opened because the puzzle has been solved.

When a coin does land in the receiving member 34, as illustrated in FIG. 14, the push rod 36 can be maneuvered so as to move the latch mechanism 120. The reason for this is that the distal end of the push rod will now contact the coin held in the coin receiving slot 132 of the receiving member 34. Any further movement of the push rod 36 will move the latch mechanism itself from the position shown in FIG. 14, i.e., the closed position, to the position shown in FIG. 15, i.e., the open position. When in the closed position, the latches 124 engage the catch members 44. In contrast, in the open position shown in FIG. 15, the latches 124 are spaced from the catches 44 thereby enabling the door 40 to pivot away from the housing bottom half 20 as shown in FIG. 16. Once the door 40 is opened, coins B held in the coin storage area defined between the door 40 and the bottom wall 30 or held in the bowl-shaped door can be accessed and retrieved. It should be appreciated that a single latch and catch assembly could be provided instead of multiple latches and catches as is illustrated in the embodiment disclosed.

A first biasing member such as a spring 150 biases the latch mechanism 120 towards the closed position as is shown in FIGS. 13 and 14. The push rod acts against the bias of the first spring 150. In order to control the movement of the push rod, a guide 156 is provided for it. In this embodiment, the guide is mounted to the bottom wall 30 as shown in FIG. 6. Biasing the push rod to a first end position is a second biasing member such as a spring 160. Thus, the push rod 36 needs to be urged against the bias of the second spring 160 in order to move it towards the receiving member 34.

The latch mechanism 120 has a first end position which is illustrated in FIG. 13, such that the latches 124 engage the catch members 44. A second end position of the latch mechanism 120 is defined by a stop 152 illustrated in FIG. 14. A second end position of the push rod is defined by a stop 162. When the stop 162 contacts the guide 156 as shown in FIG. 14, the spring 170 cannot urge the push rod any further out of the housing.

In this embodiment, the spring 160 is trapped between an enlarged diameter section 168 of the push rod and the guide 156. The spring encircles a reduced diameter section 170 of the push rod.

Figure 8B:
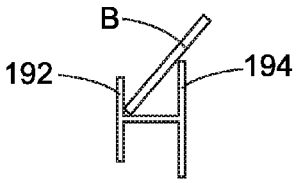
FIG. 8B is a cross sectional view of a portion of the track of FIG. 8A.
Figure 8D:
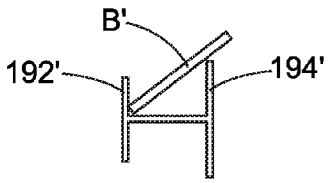
FIG. 8D is a cross sectional view of a portion of the track of FIG. 8C.
Figure 8A:
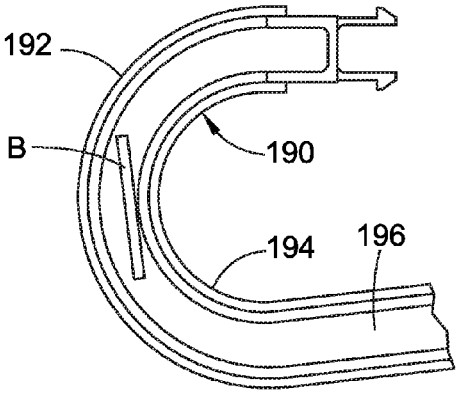
FIG. 8A is a schematic top plan view of a track section according to the present disclosure.

With reference now to FIGS. 8A-8D, there are limits on the design of the track, since it must accommodate a movement of a coin B, B' such as by rolling. To this end, the first and second side walls 192 and 194 of the track 190 need to be spaced apart far enough that the largest diameter coin meant to be used in the maze is accommodated for movement along the base wall 196 such as by rolling down the track and is not hampered in its rolling motion by either side wall of the track because the two walls of the track are too close to each other, especially in a curved portion of the track. With reference now to FIG. 8B, it can be seen that the coin B is tilted when it travels on the track, with the tilt of the coin being to the extent permitted by the track width defined between the track side walls 192 and 194 and the height of the side walls.

Figure 8C:
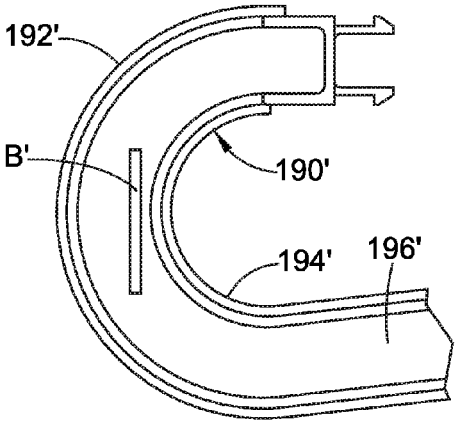
FIG. 8C is a schematic top plan view of a track section according to another embodiment of the present disclosure.

With reference now to FIG. 8C, another track according to the current disclosure is there illustrated. It can be seen that this track 190' is wider than is the track 190. More particularly, a pair of side walls 192' and 194' are spaced further apart in this embodiment, such that a base wall 196' is wider. Accordingly, a coin B' has an easier time of rolling along the track. Due to the greater spacing of the side walls from each other, the coin B' assumes a more tilted configuration than does the coin B illustrated in FIG. 8B. It should be appreciated that the tightness of track curvature is limited by the diameter of the largest coin used in the play of the maze.

A change in the height of the side walls and a change in the distance between the side walls impacts the ability of coins to move along the track. The present disclosure teaches that one is able to keep a coin of a given diameter in play on the track when tightening a curve of the track by at the same time widening the distance between the two side walls or by making the side walls higher so that the coin stands more upright and rolls on edge, or a combination of the two. By changing either or both of these dimensions, one is able to control the movement of the coin.

Thus, one can determine a minimum curvature of a coin track on which coins can travel. First, one needs to determine the diameter of the largest diameter coin which is meant to be handled on the coin track. Then, one needs to adjust at least one of the width of the base wall of the track and a height of at least one of the pair of opposed side walls of the track. In this way, the minimum curvature that a coin track can take while still accommodating a given diameter of coin can be determined. Minimizing the radius needed for curving tracks is advantageous in order to fit curving tracks into housings that are not overly large, which could negatively impact the marketability of a maze-type coin bank. In other words, smaller size housings are desirable and difficult to achieve.

Figure 9:
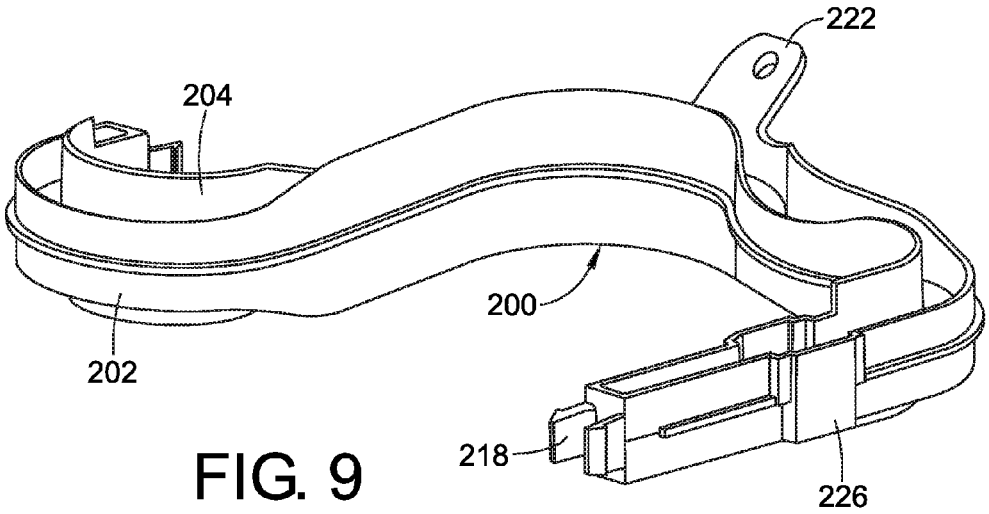
FIG. 9 is an enlarged perspective view of a track section according to the present disclosure.

With reference now to FIG. 9, a track section 200 is there illustrated. The track section includes first and second side walls 202 and 204, as well as a base wall 206 (see FIG. 10). It is apparent from FIG. 9, as well as the cross-sections of FIGS. 11A-11E, that the two sidewalls 202 and 204 of the track can be of varying heights so that along one section of the track the first side wall 202 is higher than is the second side wall, as shown in FIG. 11B, whereas in another section of the track, the second side wall 204 is higher than is the first side wall, as shown in FIG. 11D. The track 200 can also include a first end wall 212, extending from which are one or more clips 214, and a second end wall 216, extending from which are one or more clips 218. In this way, the track sections can be joined to each other. Also located on the track can be a tab section 222 which enables the track to be fastened to adjacent components of the coin bank. An enlarged section 226 can also be provided on the track. The enlarged section can be used to connect the track section 200 to another section of track in a generally perpendicular orientation to the track section 200.

While the track elements disclosed herein can be of a generally constant width, that is not a requirement. In other words, a width of the track can vary along the length of the track, if so desired. The track can have a width ranging, in one embodiment, between 0.180 and 0.220 inches. Of course, depending on the type of coin being handled in the maze, the width of the track may need to be adjusted in order to accommodate particularly thick or thin coins meant to be handled by the maze. What is necessary is that the track base wall have a width large enough to accommodate the thickest coin which is capable of being inserted into the maze.

Disclosed has been a coin bank puzzle or maze where players maneuver a coin on one of several tracks or paths inside a housing that can be transparent. In one embodiment, the housing can be in the form of a regular sphere. However, in other embodiments, the housing can be in the form of a generally spherical object made up of a multiplicity of planar hexagonal and pentagonal sections, such as a soccer ball. Other such configurations are also possible. So, too, are non-spherical configurations, such as cylinders, rectangles, cubes and the like. A three-dimensional experience is provided as the players need to turn, rotate and pivot the housing in order to keep or maintain a coin, entering the coin bank puzzle through the coin slot 100, on one of the several track sections 50 and 70-86 contained therein. Players work with gravity and rotate and/or reorient the puzzle in order to guide the coin along the track. Success is achieved when the coin lands in the coin receiver 34. When it does, movement of the push rod 36 can open the door 40 by separation of the latch from the catch. Opening the door allows coins held in the coin container at the base of the coin bank puzzle to be retrieved. However, if the coin departs the track construction, it will eventually drop onto the bottom wall 30 and can then be slid into and through the opening 110 in the bottom wall so as to fall into the coin holder or storage area. If this occurs, another coin will need to be fed into slot 100 in order to try to solve the three dimensional puzzle or maze and access the coin storage area.

The serpentine maze-type track construction illustrated herein is composed of a variety of track segments of varying shapes, sizes and lengths, as is evident from FIG. 1. A lengthy maze-like track construction is provided with numerous options which allow variations in the play of the maze or puzzle. The track configuration set forth and illustrated herein shows one particular example of a track construction, according to an embodiment of the present disclosure. It should be appreciated that numerous other track configurations could be devised with a variety of shapes for the several track sections. For example, an easier track layout could be designed for a child's version of the puzzle while a more difficult track layout could be designed for expert players. Disclosed has been a maze or labyrinth-type coin bank which requires manual dexterity of the user along with puzzle solving skills. Further, the maze-type coin bank combines play value with money saving or coin saving opportunities.

The disclosure has been described with reference to a preferred embodiment. Obviously, modifications and alterations will occur to others upon a reading and understanding of the preceding detailed description. It is intended that the disclosure be construed as including all such modifications and alterations insofar as they come within the scope of the appended claims or the equivalents thereof.

I claim:

1. A maze coin bank comprising:

a housing including a wall, an inlet opening and an exit;

a three dimensional track construction held in the housing, including a plurality of sections extending along different axes which accommodate an associated coin for movement along the track construction, wherein each of the plurality of sections is open so that the associated coin is allowed to fall off the track construction, the track construction including:

a coin entrance portion communicating with the inlet opening, and an exit portion;

wherein the exit of the housing comprises an opening in the housing and a closure for selectively closing the opening; and a mechanism for opening a lock selectively locking the closure, wherein the mechanism includes:

a coin receiving member movably mounted to the housing and communicating with the exit portion of the track;

a push rod movably mounted to the housing;

a first biasing member for biasing the coin receiving member to a first end position; and a second biasing member for biasing the push rod to a first end position.

2. The coin bank of claim 1 wherein the housing is generally spherical in shape.

3. The coin bank of claim 1 wherein the track construction includes a base wall and spaced apart first and second side walls wherein the track construction accommodates an edge of the associated coin in order to enable the associated coin to roll along the track.

4. The coin bank of claim 3 wherein the first and second side walls have at least in part different heights.

5. The coin bank of claim 1 wherein the closure comprises a door which includes a catch and the lock includes a latch connected to the coin receiving member and cooperating with the catch.

6. The coin bank of claim 1 wherein the coin receiving member slides linearly in relation to the housing.

7. The coin bank of claim 1 wherein the plurality of sections of the track construction include:

a first section extending along a first axis;

a second section extending along a second axis which is oriented generally perpendicular to the first axis; and a third section extending along a third axis which is oriented generally perpendicular to the first axis and the second axis.

8. A maze coin bank comprising:

a housing including a coin entrance opening and an exit opening;

a closure mounted to the housing for selectively covering the exit opening;

a coin storage area defined in the closure or between the housing and the closure;

a lock mounted to one of the closure and the housing;

a coin track accommodated inside the housing, wherein the coin track includes:

a plurality of sections extending along different axes, wherein each of the plurality of sections is open so that an associated coin is allowed to fall off the track construction, a coin entrance portion, an exit portion; and, a mechanism to facilitate an actuation of the lock wherein the mechanism comprises:

a push rod movably mounted to the housing;

a first biasing member for biasing the push rod into one end position;

a coin receiving member movably mounted to the housing or the closure, the coin receiving member communicating with the exit portion of the track; and a second biasing member for biasing the coin receiving member to one end position.

9. The bank of claim 8 wherein the housing is generally spherical in shape.

10. The bank of claim 8 wherein the coin track accommodates a rolling of the coin along the track.

11. The bank of claim 8 wherein the track includes a base wall and a pair of side walls spaced from each other.

12. The bank of claim 11 wherein the track side walls are, at least in part, of different heights or the base wall is of different widths along a length of the track.

13. The bank of claim 11 wherein the track includes sections which are two sided.

14. The bank of claim 8 further comprising a coin transfer member in communication with the track.

15. The bank of claim 8 further comprising a base located in the housing for accommodating the coin receiving member and the lock and wherein the base is located between the coin track and the closure.

16. The bank of claim 8 wherein the closure comprises a door and further comprising a pivot element for pivotally mounting the door to the housing.

17. The bank of claim 8 wherein the plurality of sections of the coin track include at least two sections extending along mutually perpendicular axes.

* * * * *